US005454475A

United States Patent [19]

Kaufhold

[11] Patent Number: 5,454,475

[45] Date of Patent: Oct. 3, 1995

[54] LUBRICATION MEANS FOR SLACK-FREE RAILCAR CONNECTIONS

[75] Inventor: Horst T. Kaufhold, Aurora, Ill.

[73] Assignee: Amsted Industries Incorporated, Chicago, Ill.

[21] Appl. No.: 216,177

[22] Filed: Mar. 22, 1994

[51] Int. Cl.[6] ..... B61G 7/00

[52] U.S. Cl. ..... 213/56

[58] Field of Search ..... 213/50, 56, 61, 213/57; 184/5, 7.4, 8, 105.4

[56] References Cited

U.S. PATENT DOCUMENTS

| | | | |
|---|---|---|---|
| 3,985,205 | 10/1976 | Hedlund et al. | 184/7.4 |
| 4,103,978 | 8/1978 | Hoornstra | 184/5 |
| 4,593,829 | 6/1986 | Altherr | 213/75 R |
| 4,700,853 | 10/1987 | Altherr et al. | 213/50 |
| 5,007,504 | 4/1991 | Hallback | 184/5 |
| 5,035,338 | 7/1991 | Kaufhold et al. | 213/50 |
| 5,205,376 | 4/1993 | Nowak | 184/5 |
| 5,366,043 | 11/1994 | Kretschmer et al. | 184/5 |

*Primary Examiner*—Mark T. Le
*Attorney, Agent, or Firm*—Edward J. Brosius; F. S. Gregorczyk; Thomas J. Schab

[57] ABSTRACT

Slack-free or slackless coupling systems have application in various types of coupling arrangements such as drawbars, articulated connectors, and E and F type couplers. The gravity wedge that takes up any slack developed when the system components wear, maintains a constant longitudinal force on the follower block and coupler member butt-end interface. However, under high buff loading, that mated interface develops high friction forces during curving and angling. It has been found that the lateral component of these friction forces can become great enough to cause wheel lift at the wheel/rail interface. The present invention reduces that component of friction by greatly reducing the coefficient of friction at the coupler/follower block interface by supplying a lubricant between these surfaces. The present invention incorporates a series of lubrication retention reservoirs in the follower block front face to hold and distribute lubricant such that each time the coupler member butt-end laterally and vertically angles, lubricant within the reservoirs is wiped out of the reservoirs. The reservoirs are large enough to hold enough lubricant until the car is serviced for maintenance. Alternatively, a manual or automatic lubricant supply system can be used in conjunction with the follower block to ensure that lubricant is always held within the reservoirs.

32 Claims, 4 Drawing Sheets

LUBRICATION MEANS FOR SLACK-FREE RAILCAR CONNECTIONS

BACKGROUND OF THE INVENTION

1. Field of the Invention

This invention relates to the art of slackless railcar connections such as couplers, drawbars, articulated connectors and the like having a gravity wedge component that functions to move downwardly so as to fill up the space created when the other parts of the slack-free system wear. More specifically, it is directed to an improved follower block which contains lubrication retention grooves for retaining and communicating a lubricant between the follower block and the coupler end in order to reduce the lateral coupling friction which could contribute to wheel lift and possible derailment.

2. Description of the Related Art

Slackless coupling systems are well known in the art wherein the principle object of these types of coupling systems is to hold the coupler member in such a way as to minimize longitudinal movement with respect to the car body. When the coupling system is first assembled, clearances between the components are minimal and there is virtually no slack or movement of the components longitudinal of the car. However, wear eventually develops through use (deemed free slack) and the cumulative effect is to magnify the longitudinal impact forces caused by free slack.

Slackless coupling systems have cured this problem by adding a gravity wedge between the follower block and the closed end of the pocket sill casting. The wedge tends to force the follower block away from the pocket casting end wall and firmly against the butt-end of the coupler member. When cars are being pushed, the longitudinal buff loads cause compression of the coupler member against the follower, wedge and pocket casting end wall. When cars are being pulled, the longitudinal draft loads tend to separate the coupler from the pocket casting. Upon separation, the gravity wedge descends to fill up the slack and once again, maintain contact between the coupler, follower, and pocket casting. Examples of slackless railcar connections are shown in U.S. Pat. Nos. 5,035,338; 4,700,853; and 4,593,829. Typical in such slackless systems, the mating faces of the follower block and gravity wedge, as well as the follower block and coupler are preferably curved to permit the coupler to pivot slightly both vertically and laterally. Since slack-free connections as those just described are usually under some longitudinal loading from the action of the gravity wedge under draft or buff loading, it is desirable to reduce the frictional resistance present during vertical and lateral angling. It has been found that under high longitudinal buff loading the frictional forces at the follower block/coupler interface might create lateral force components high enough to cause wheel lift. Wheel lift is a condition where the wheel of a railway truck is actually disengaged from the rail. This condition is especially pronounced when railcars are forced to undergo extreme cornering or curving conditions, as when being switched at low speed, within a rail yard. Under certain conditions, wheel lift can lead to a derailment.

BRIEF SUMMARY OF THE INVENTION

Accordingly, it is a principal object of the invention to greatly reduce the lateral forces operating on a railcar coupling assembly such that wheel lift at the wheel/rail interface is eliminated.

It is a related object of the invention to substantially reduce the friction forces operating on a slack-free railcar coupling assembly, namely between the mated surfaces of the coupler member and the follower block, as those forces comprise the largest contribution to the lateral forces that might cause wheel lift.

It is another object of the invention to provide a means to retain lubricant within the slack-free assembly so that during continued operation, some lubricant will always be present for reducing the friction between the mated surfaces, which thereby reduces the lateral forces operating on the coupling assembly.

It is another object of the invention to provide an external means to supply lubricant to the lubricant retention means such that fresh lubricant will be intermittently supplied to the mated surfaces of the slack-free assembly without disassembly of the system.

It is still another object of the present invention to provide a lubricated slack-free coupling assembly so as to reduce wear between the mated surfaces, thereby increasing component life.

To this end, the present invention provides an improved follower block which can accomplish these objectives by including a series of lubrication retention reservoirs on the mated front face of the follower block for retaining and communicating a lubricant therebetween which substantially reduces the friction between the mated surfaces. The improved follower block also includes provisions for interfacing the external lubricant supply means with the follower block in order to ensure such low friction operation until the railcar is serviced for scheduled maintenance.

BRIEF DESCRIPTION OF THE DRAWINGS

Further objects and advantages will become apparent upon reading the following detailed description in conjunction with the drawings wherein.

DETAILED DESCRIPTION OF THE INVENTION

While it was previously mentioned that the present invention can be used with any type of slack-free coupler system, for purposes of this discussion, the present invention will be described in conjunction with a slack-free drawbar system. Therefore, it should be understood that whenever reference is made herein to a drawbar buR-end, a similar butt-end is provided whether the coupler system consists of a drawbar, an articulated connector, or an E or F type coupler.

Figure 1:
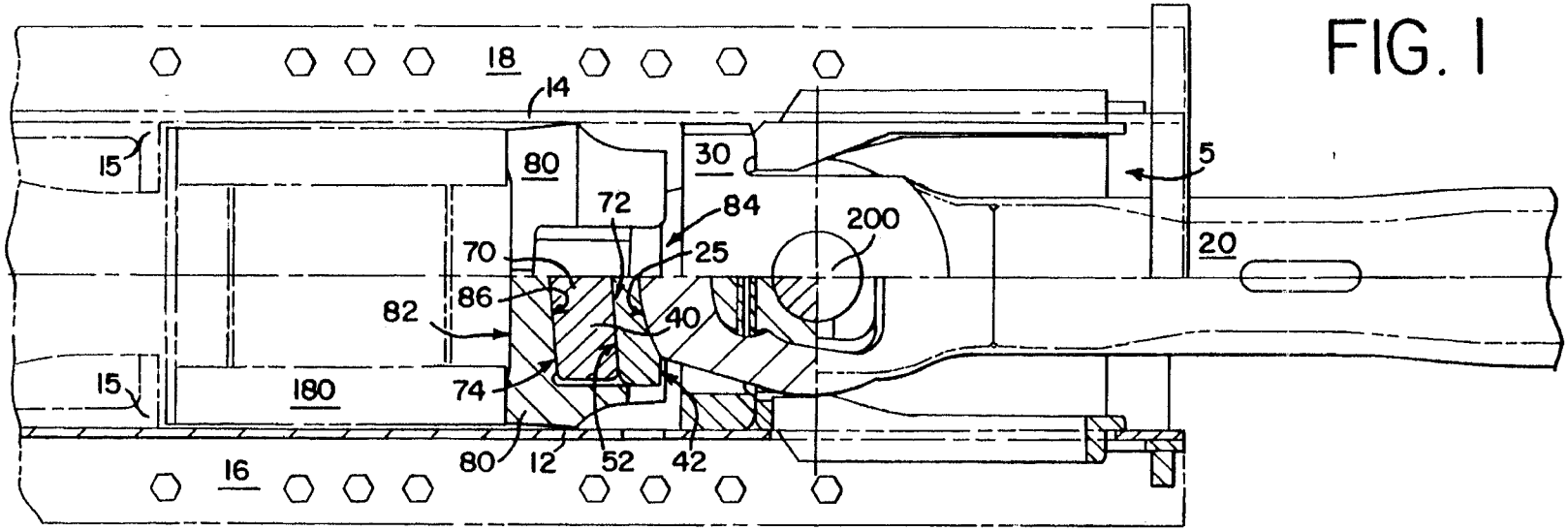
FIG. 1 is top view of a slack-free coupler assembly shown in partial section.
Figure 2:
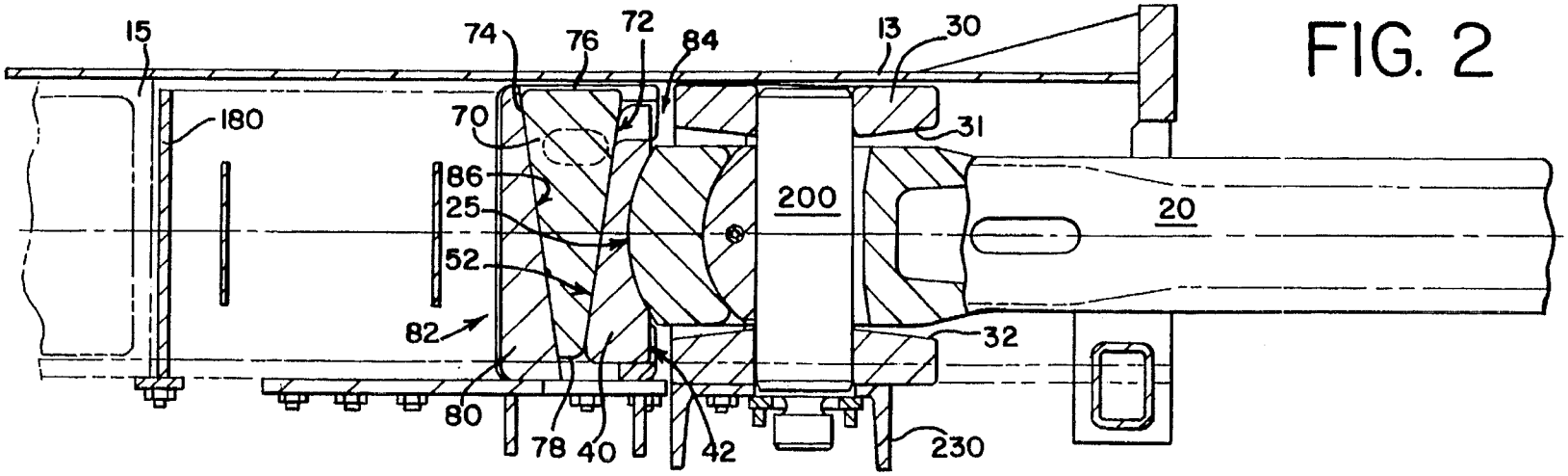
FIG. 2 is a plan view of the assembly shown in FIG. 1, also shown in partial section.

Referring to the slack-free drawbar assembly of FIGS. 1 and 2, a drawbar 20 is generally shown with a convex butt-end 25 of the drawbar 20 being inserted into the open end 5 of center sill 10. The center sill is of standard U-shaped construction having a top wall 13, sidewalls 12 and 14, and out turn flanges 16, 18. As seen from FIG. 2, drawbar 20 is received within short yoke retention member 30 and pivotally held in place by a vertical connecting pin 200. Butt-end 25 longitudinally extends through an opening in the short yoke member 30 and the top and bottom walls 31, 32 of the short yoke member are chamfered to allow vertical angling of the drawbar. Short yoke member 30 is retained within center sill 10 by supporting member 230 which transverses the bottom of the open center sill and is bolted to respective flange members 16 or 18. Arrayed between the butt-end 25 of drawbar 20 and rear center sill stops 15 is follower block 40, pocket casting 80, gravity wedge 70 and spacer block 180, if required. If the spacer block 180 is not required, the pocket casting 80 will directly abut the rear stops 15. Pocket casting 80 is a box-like structure having an open end 84 and closed end 82 deemed by rear wall 86. Follower block 40 is held within casting 80 near the open end 84. Follower block front face 42 contacts butt-end 25 while follower block rear face 52 contacts gravity wedge 70, also retained within pocket casting 80. As is usual with slackless type connections, gravity wedge 70 has front and rear faces 72, 74 respectively, which define a body that tapers from a relatively broad top surface 76, to a relatively narrower bottom surface 78. The pocket casting rear wall 82 and the follower block rear face 52 have bearing surfaces that are angled vertically and are congruent to the taper of the wedge so as to abut each front 72 and rear surface 74 of the wedge and maintain the wedge in an upright position as it points downwardly.

Figure 3:
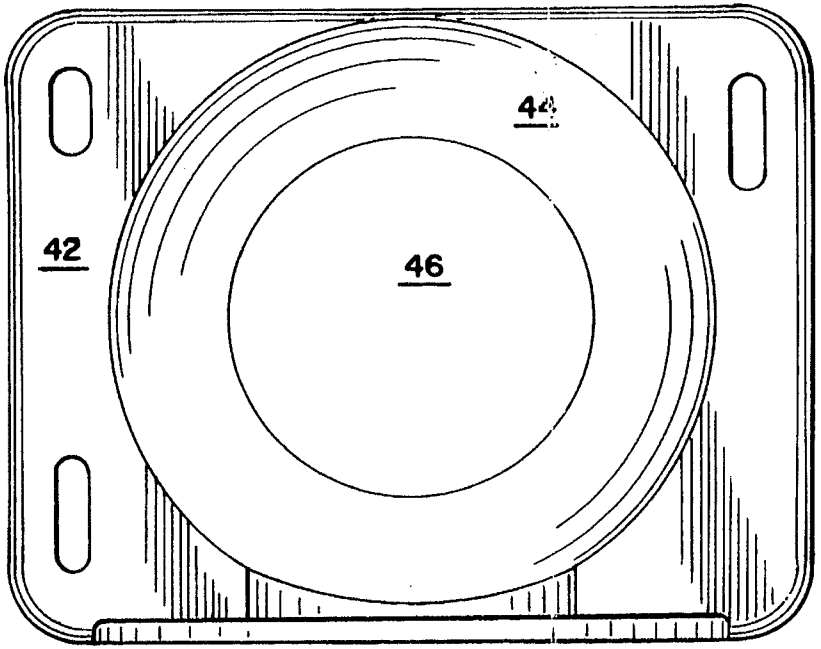
FIGS. 3–5 are front, top, and side views of a prior art follower block typically used in a slack-free coupler assembly.
Figure 4:
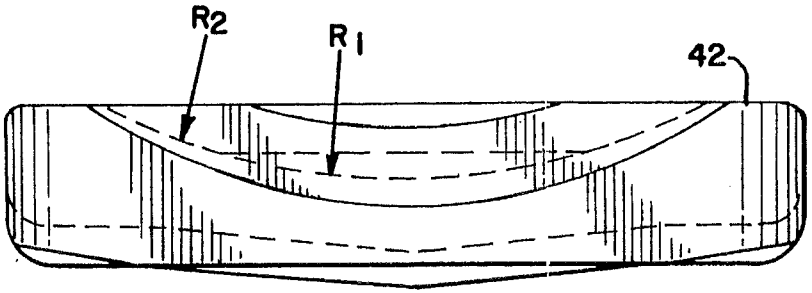
Figure 5:
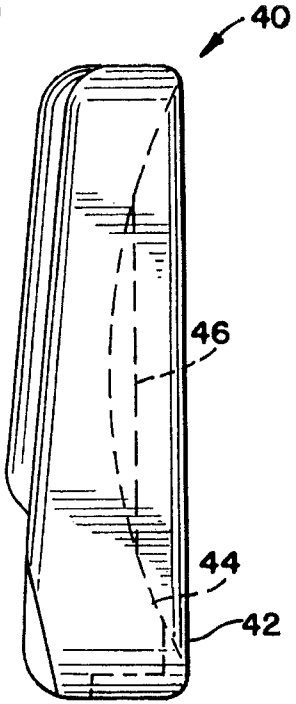

In operation of a slack-free system, as the interface between butt-end 25 and follower front face 42 wears and develops slack, gravity wedge 70 descends within the pocket casting to continuously push and maintain follower block 40 into contact with butt-end 25. By referring now to FIGS. 3–5, it will be realized follower block 40 has a front face 42 which is generally concave, having a compound curvature to provide a concave annulus 44 that merges smoothly with a relatively shallower inner cavity or recess 46. Preferably, both the annulus surface 44 and the inner recess 46 are partial spherical surfaces with the inner recess formed from a spherical radius R1 that is less than the spherical radius R2 of the annulus surface 44. It is to be understood that the annulus surface 46 is formed to be substantially concentric with the butt-end 25 of drawbar 20, that is, the spherical radius R1 of annulus surface 46 is substantially equal to the spherical radius of butt-end 25. By providing the inner recess of radius R1, contact between the butt-end 25 and the follower block 40 is substantially maintained at the center of the follower block 40.

As drawbar 20 angles vertically or laterally during operation, follower front face 42 and butt-end 25 develop friction forces. It has been found that under high buff loads the friction forces between the butt-end 25 and the follower 40 can become so high that these forces can actually affect the proper wheel-to-rail interface; in extreme conditions the wheel can lift off the track and even cause derailment. Furthermore, the repeated rubbing of these two surfaces accelerates the useful life of the follower block and the butt-end of the drawbar, and the replacement cost of a drawbar or any other type of coupler can be fairly substantial. The present invention is concerned with substantially reducing the friction forces between these mated surfaces in order to greatly reduce the vertical or lateral friction force components operating on the wheel/rail interface. Doing so will also greatly reduce or eliminate the possibility of derailment.

When a slack-free system is initially assembled, the front surface of the follower block is typically coated with a lubricant material such as grease, in order to reduce the friction forces between the follower and the drawbar butt-end surfaces during break-in. The initial act of lubricating also slows the development of wear on the components as well as the associated development of free slack. As the railcar encounters curved or uneven sections of track, the drawbar undergoes continuous lateral and vertical angling, causing the lubricant to be displaced from the mated follower/butt-end surfaces. It is known that all of the lubricant is displaced after only several months of service even though it is highly desirable to retain the lubricant until the car is disassembled for scheduled maintenance, which is between 400,000 to 600,000 miles of service.

Figure 7:
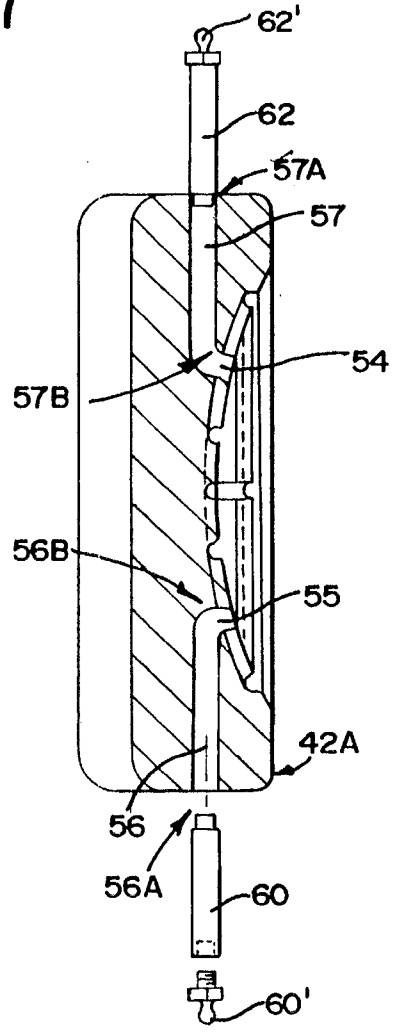
FIG. 7 is a top view of the follower shown in FIG. 6 shown in partial cross section.
Figure 6:
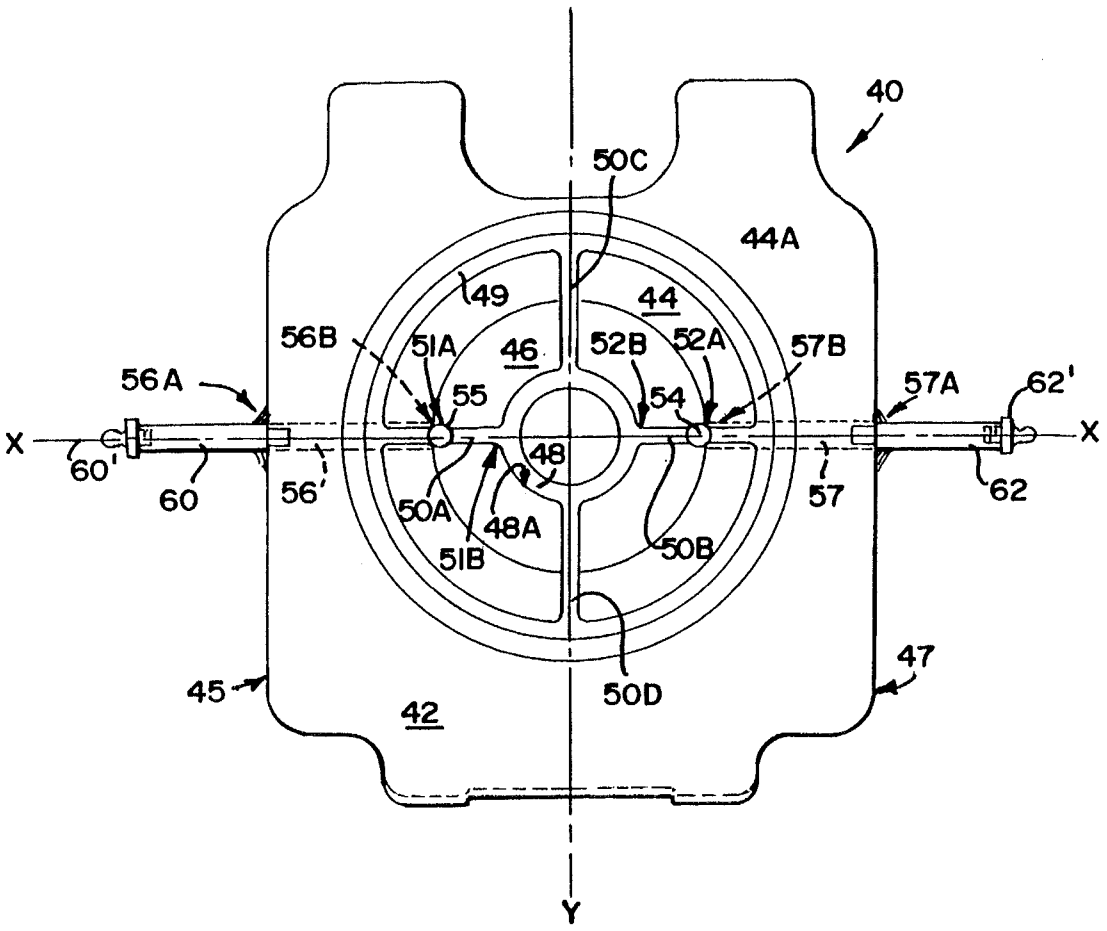
FIG. 6 is a front view of the follower block of the present invention showing the lubricant retention means and the lubrication supply means.

The follower block of the present invention is directed towards retaining a supply of lubricant between the mated surfaces of the follower block and the drawbar butt-end each time the butt-end operationally wipes against the front face of the follower block and until scheduled maintenance arrives. FIGS. 6 and 7 are illustrations of the follower block of the present invention showing a lubricant retention means incorporated into the follower block. The means insures that once a lubricant material is initially applied to the follower block front face and fills the reservoirs, the lubricant will remain in place and supply lubricant to the mentioned interface until the next maintenance cycle. Preferably, a high temperature oil based grease should be used as the lubricant material because it has been found that such grease will not dry out and flake as do molybdenum-based lubricants.

As seen, the lubricant retention means is comprised of a series of lubricant reservoirs in the form of open grooves formed on the front surface 42 of follower block 40. It is preferable that all grooves be cast as part of the follower block, although nothing would preclude them from being machined.

As illustrated in FIGS. 6 and 7, when butt-end 25 slides against follower block 40, the spherical inner portion 46 will wear down. As mentioned earlier, inner portion 46 is a feature used for keeping the butt-end centered on the follower block during the initial break-in, or wearing of the slack-free coupling components. When initially assembled, all components collectively lack free slack which makes the slack-free assembly operationally stiff. During this period, the lateral forces acting at the wheel/rail interface are the greatest since the friction between the follower block and the drawbar is the greatest. Keeping these forces as low as possible becomes crucial because the high lateral forces developed under high buff loads are a contributor to the cause of wheel lift. Therefore, it is clear that keeping this mated interface well lubricated is very important toward the prevention of potential derailment problems.

To accomplish thorough lubricant distribution, the inner portion 46 of follower block 40 has been provided with an inside circular groove 48 and linear horizontal and vertical grooves 50A–50D. FIG. 6 show that the linear grooves coexist on the legs of the X–Y axis, while inside circular groove 48 is centered about the axis. A second circular groove 49 is concentric with inner circular groove 48, and it too, is generally centered about the X–Y axis. It should be clear that the X–Y axis also corresponds to the horizontal and vertical centers of the follower block itself. Closer inspection of FIG. 6 show that the vertical and horizontal linear reservoirs only extend from the outside edge 48A of inside circular reservoir 48 to outside circular reservoir 49. Providing only the reservoir area as shown, ensures that load bearing surface area will not be compromised. As inner portion 46 incrementally wears down, butt-end surface 25 will eventually contact the bottom of recess 44. This means that lubricant retained within each of the reservoirs will also be incrementally displaced from that respective reservoir and distributed across the mating surfaces. Since there are reservoirs at the inner and outer portions of the follower, a supply of lubricant will be present across the entire face of the follower block at all times.

In a preferred embodiment, the lubricant retention means may also include a means for externally supplying the lubricant to the reservoirs once the slack-free system has been assembled; the supply can either be continuous or periodic. The continuous supply would consist of adding a pressure-regulated lubricant system to the slack-free assembly for supplying the lubricant to the reservoirs, while the periodic supply would simply consist of an operator manually adding lubricant via a grease gun. In either case, the follower 40 is arranged to permit the lubricant to be supplied from the external supply means through horizontal internal cylinders 56 or 57 that are formed through the midsection of the follower block. Each cylinder extends inwardly from a respective follower block sidewall 45 or 47, to a point coincidental with the outside edge 43 of inner cavity 46, wherein each cylinder is also articulated with a respective upwardly extending port 54 or 55. Each port 54, 55 extends perpendicularly from the follower block midsection, or from internal cylinders 56 and 57, outwardly to the surface 42A of follower block front face 42 and to horizontal grooves 50A and 50B. The horizontal linear grooves 50A and 50B shown in FIG. 6, each have a respective first end 51A and 5lB, and a respective second end 53A and 53B. Each respective second end 53A, 53B is joined to a respective port 54 and 55 such that any lubricant externally flowing through cylinders 56 or 57 will travel towards the follower block center, where ports 54 or 55 will further communicate the lubricant into each of the grooves. Horizontal linear grooves 50A and 50B will then communicate the lubricant simultaneously in a dual direction, both towards the follower block outside circular groove 49 and towards the inner circular groove 48. The dual directional flow is possible only because each respective port 54 or 55 is located at about the midpoint between each groove's first and second end. It should be realized that since follower block 40 is always mated against butt-end 25, the butt-end surface 25A effectively closes the open linear grooves 50A–50D. This means that the externally supplied lubricant will be directed down each of the lateral linear grooves 50A or 50B and into the central circular groove 48. FIG. 6 also illustrates that the vertical linear grooves 50C and 50D are not articulated with either of the internal cylinders 56 or 57. They are indirectly fed lubricant, as will be explained.

As illustrated, central circular groove 48 also intersects with each of the vertical grooves 50C and 50D, so that after the lubricant completely fills circular groove 48, the lubricant will be forced to communicate the lubricant upwardly and downwardly to opposite diametrical ends of outer circular groove 49. Outer circular groove 49 is concentric with inner circular groove 48 and is generally located slightly inward from outer edge 44A with defines the outer boundaries of recess 44.

Figure 8B:
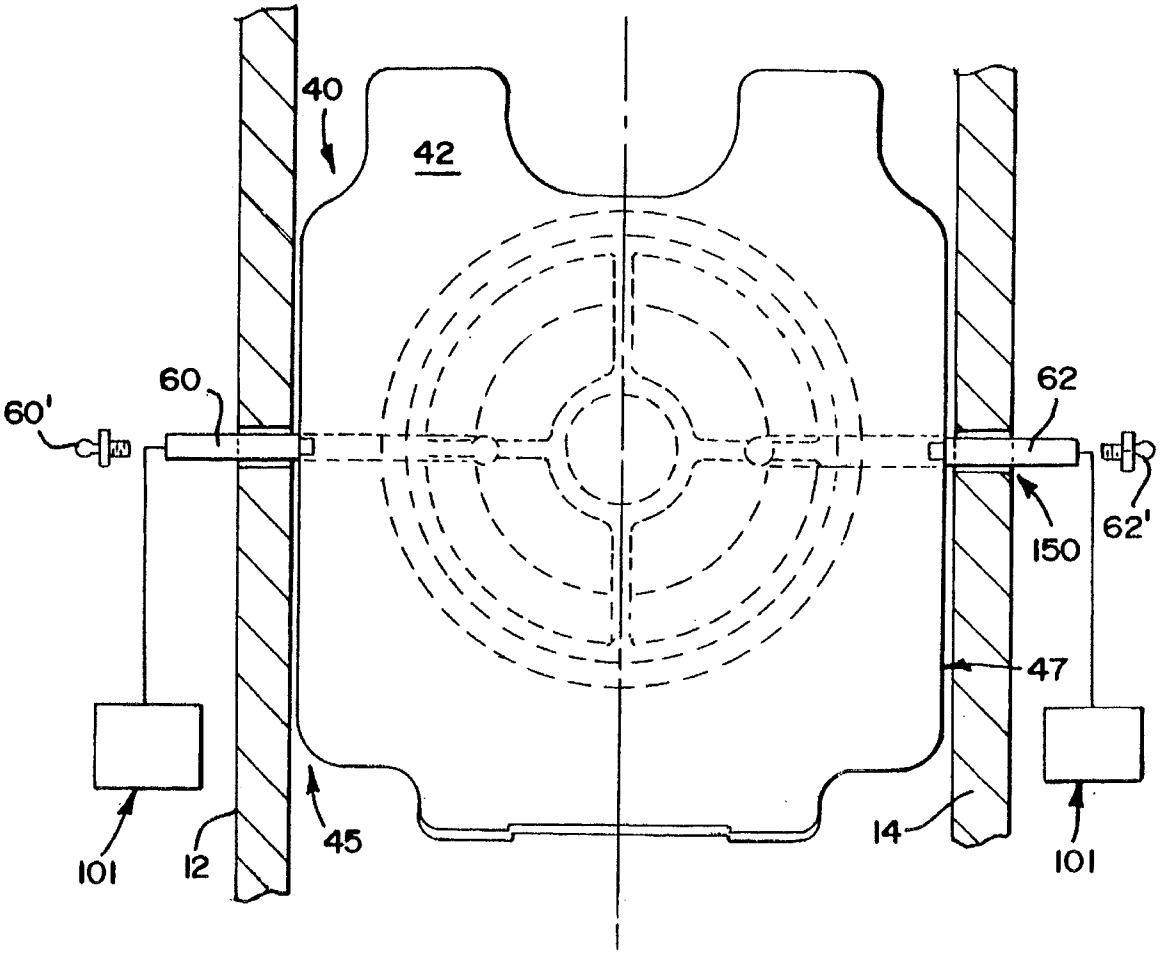
FIG. 8B is a front view of the preferred follower block showing the arrangement necessary for manually supplying lubricant on an intermittent basis to the follower block.
Figure 8A:
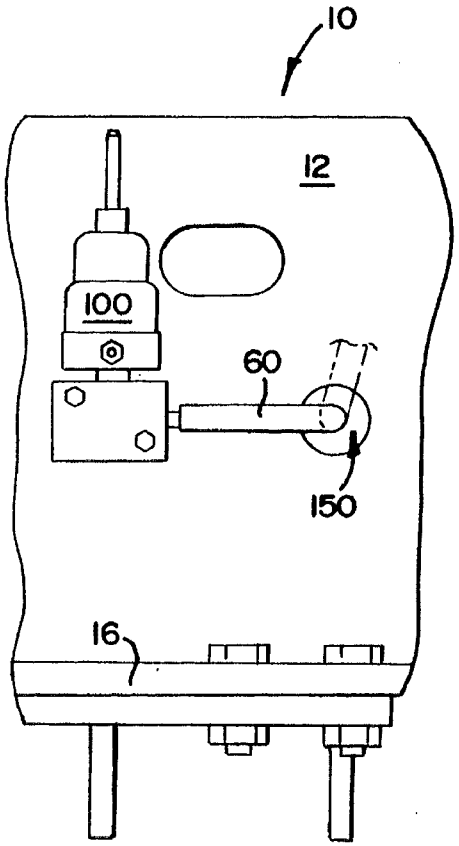
FIG. 8A is a side view of the preferred arrangement for continuously supplying lubricant to the follower block; it is attached to the outside surface of the center sill sidewall.

In the preferred embodiment, the external lubrication means also includes a means attached to either of the follower sidewalls 45 or 47 for interfacing the follower block 40 with the supply of lubricant, which is physically located outside the center sill. FIG. 8A shows that when a continuous supply system is used, the interfacing means comprises a respective tube 60 or 62, inserted into a respective inlet 56A or 57A of each internal cylinder 56, 57. Each tube 60 or 62 extends through a respective center sill sidewall access hole 150 in either of the sidewalls 12 or 14 to connect to the follower block 40 to the regulated outside source of lubricant material. Each tube 60 or 62 should be attached to the respective follower block sidewall by any commonly known method such as welding, brazing, etc. As FIG. 8A also illustrates, the continuous external source of lubricant is fed into the follower on an as need basis, determined by a decrease in back pressure on a pressure regulator attached to the repository 100 holding the lubricant. A decrease in back pressure signifies that the lubricant has been displaced from between the follower/butt-end interface. Preferably, the tubes 60 or 62 are constructed from thick-walled flexible metallic or non-metallic tubing, although small diameter pipe can also be used. Also, it is preferable to enlarge the access holes 150 to a diameter of at least three times the diameter of the tubing or pipe in order to allow at least an equivalent of one diameter forward or backward movement of follower 40. In this way, the larger access holes ensure that a line will not become pinched or broken, thereby resulting with a reduced or discontinued supply of lubricant.

Alternatively, instead of the continuous supply system, an intermittent or manual system can be used to periodically refill the lubricant retention reservoirs. This method would involve an operator who would connect a grease gun to an alternate interfacing means 60', 62', and then pump lubricant into the reservoirs by hand. FIG. 8B includes a diagram 101 representing an operator operating a grease gun to pump lubricant into the reservoirs by hand. In that situation, the interfacing means 60', 62' would be comprised of common grease fittings either attached directly at the follower blocks sidewalls 45 or 47 at the inlets 56A or 57A of the internal cylinders 56 or 57, or they could be attached to tubing inserts 60 or 62 which are similar to the ones used in the continuous system. The fittings should be the known Zerk™ fittings; and they too would be accessible through the sill sidewall access holes 150 on either center sill sidewall 12 or 14. Once the operator pumps lubricant into either interfacing means 60' or 62', the lubricant is distributed throughout the reservoirs in exactly the same manner as already described for the continuous method. Re-filling the lubrication retention reservoirs could be done periodically at the departure terminal or at the arrival site.

It should be understood that if no outside supply means is used, or if the manual version is used, it is important for the reservoirs to volumentrically contain enough lubricant reserve for continuously wiping lubricant across the contact surfaces of the follower block and butt-end throughout the time period it takes to reach the maintenance cycle. It is therefore preferred to cut all circular and linear grooves and internal cylinders to the same width and depth. Preferably, the width and depth should be at least 0.25 inches. In this way, each retention reservoir will retain enough lubricant while still providing enough bearing surface area.

The foregoing description has been provided to clearly define and completely describe the present invention. Various modifications may be made to the various disclosed embodiments without departing from the scope and spirit of the invention, which is defined in the following claims.

I claim:

1. In an inverted U-shaped center sill having a top wall interconnecting a pair of laterally spaced sidewalls, each of said sidewalls having opposed front stops and opposed rear stops, said front and rear stops longitudinally spaced from each other within said center sill, an improved slack-free railcar assembly comprising:

a pocket casting having a closed end and an open end, said closed end facing said rear center sill stops and said open end facing said front stops and accepting a butt-end of a coupler member, said butt-end defined by a surface having a radius of curvature;

a follower block having a front face and a rear face, said front face including a central portion and an outer portion, said central portion is a spherical cavity and said outer portion is an annulus that surrounds and smoothly merges with said spherical cavity, said central portion being formed from a first spherical radius of curvature and said outer portion being formed from a second spherical radius of curvature that is greater than said first spherical radius, said first spherical radius of curvature complementary to said butt-end radius of curvature, said follower block held within said pocket casting near said open end with said follower block front face in mated relationship with said butt-end of said coupler member;

a gravity wedge also held within said pocket casting, said wedge disposed between said pocket casting closed end and said follower block rear face, wherein said follower block front face includes means for retaining a lubricant, said means for retaining a lubricant comprising a series of grooved reservoirs, each of said reservoirs retaining a supply of said lubricant such that as said butt-end undergoes vertical and lateral angling, said mated relationship will be continuously wiped with said lubricant, said lubricant reducing the friction forces between said mated coupler butt-end and said follower block front face.

2. The slack-free connection of claim 1 wherein said lubricant is comprised of a high temperature oil based grease.

3. The slack-free connection of claim 1 wherein said series of grooved reservoirs are both circular and linear in shape.

4. The slack-free connection of claim 3 wherein said circular grooves are comprised of at least two concentric grooves that are spaced from each other and said linear grooves are comprised of at least two vertically disposed grooves and at least two horizontally disposed grooves.

5. The slack-free connection of claim 4 wherein said vertically disposed linear grooves are in alignment with each other and said horizontally disposed linear grooves are in alignment with each other, said horizontally and vertically disposed grooves substantially at right angles with respect to each other.

6. The slack-free connection of claim 5 wherein said vertical and horizontal grooves are disposed between said spaced concentric circular grooves.

7. The slack-free connection of claim 6 wherein said vertical and horizontal grooves connect said concentric circular grooves together.

8. The slack-free connection of claim 7 wherein said horizontal grooves do not directly connect to each other and said vertical grooves do not directly connect to each other; none of said horizontal grooves directly connecting with said vertical grooves.

9. The slack-free connection of claim 8 wherein said spaced concentric circular grooves comprise at least one circular groove within said follower block outer portion and at least one circular groove within said follower block inner portion.

10. The slack-free connection of claim 9 further including an external means for supplying said lubricant to said lubricant retention reservoirs.

11. The slack-free connection of claim 10 wherein said external supply means comprises a source of lubricant external to said center sill, a means for interfacing said external supply with said follower block and at least one internal port and one internal cylinder formed within said follower block for communicating said lubricant from said interfacing means to said lubricant retention reservoirs.

12. The slack-free connection of claim 11 wherein each of said internal cylinders has an inward end and an outward end, said outward end coinciding with said follower block sidewall and said inward end coinciding with an outside edge of said follower block central portion.

13. The slack-free connection of claim 12 wherein said internal cylinder is disposed at a midpoint between said follower block front face and said follower block rear face, said cylinder extending perpendicularly from said sidewall to said internal port, said internal cylinder articulated with said internal port.

14. The slack-free connection of claim 13 wherein said internal port is disposed perpendicular to said internal cylinder, said internal port outwardly extending from said cylinder inward end to said follower block front face.

15. The slack-free connection of claim 14 wherein said external source of lubricant comprises a pressure-regulated lubricant repository containing a lubricant.

16. The slack-free connection of claim 15 wherein said repository is mounted on said center sill outside wall.

17. The slack-free connection of claim 16 wherein said means for interfacing comprises at least one tube having a first end and a second end, said first end connected to said repository and said second end connected to said follower block internal channel outward end, said tube extending through a throughbore in said center sill sidewall.

18. The slack-free connection of claim 17 wherein said tube second end is inserted within said follower block internal cylinder.

19. The slack-free connection of claim 18 wherein said repository continuously supplies lubricant to said follower block.

20. The slack-free connection of claim 19 wherein said interfacing means is comprised of tubing.

21. The slack-free connection of claim 20 wherein said interfacing means is comprised of pipe.

22. The slack-free connection of claim 14 wherein said external source of lubricant comprises a manually operated grease gun containing a lubricant.

23. The slack-free connection of claim 22 where said means for interfacing comprises a one-way flow device, said device attached to said outward end of said internal cylinder for only allowing communication of said lubricant from said grease gun to said internal cylinder as said gun is operated, said lubricant unable to escape said internal cylinder after said grease gun is detached from said one-way flow device.

24. The slack-free connection of claim 22 wherein an operator pumps lubricant from said external source into said internal cylinder via said interfacing means.

25. An improved follower block for use in a slack-free railcar assembly wherein a butt-end of a coupler member is in mated relationship with said follower, the improved follower block comprising:

a top wall, a bottom wall and a pair of sidewalls, each of said sidewalls connecting said top and bottom walls to define a front face and a rear face, said from face including a central portion and an outer portion, said central portion is a circular cavity and said outer portion is an annulus that surrounds and smoothly merges with said circular cavity, said central portion being formed from a first spherical radius of curvature and said outer portion being formed from a second spherical radius of curvature that is greater than said first radius, said first spherical radius of curvature complementary to a spherical radius of curvature of said coupler member butt-end, said follower block front face includes means for retaining a lubricant, said means for retaining a lubricant comprises a series of grooved reservoirs, each of said reservoirs retaining a supply of said lubricant such that as said butt-end undergoes vertical and lateral angling, said mated relationship will be continuously wiped with said lubricant, said lubricant reducing the friction forces between said mated coupler butt-end and said follower block front face, thereby reducing the potential to cause wheel lift at an interface between a railway wheel and a rail.

26. The improved follower block of claim 25 wherein said series of grooved reservoirs are both circular and linear in shape.

27. The improved follower block of claim 26 wherein said circular grooves are comprised of at least two concentric grooves that are spaced from each other and said linear grooves are comprised of at least two vertically disposed grooves and at least two horizontally disposed grooves.

28. The improved follower block of claim 27 wherein said vertically disposed linear grooves are in alignment with each other and said horizontally disposed linear grooves are in alignment with each other, said horizontally and vertically disposed grooves substantially at right angles with respect to each other.

29. The improved follower block of claim 28 wherein said vertical and horizontal grooves are disposed between said spaced concentric circular grooves.

30. The improved follower block of claim 29 wherein said vertical and horizontal grooves connect said concentric circular grooves together.

31. The improved follower block of claim 30 wherein said horizontal grooves do not directly connect to each other and said vertical grooves do not directly connect to each other; none of said horizontal grooves directly connecting with said vertical grooves.

32. The improved follower block of claim 31 wherein said spaced concentric circular grooves comprise at least one circular groove within said follower block outer portion and at least one circular groove within said follower block inner portion.

* * * * *